United States Patent [19]

Costa

[11] 4,383,778

[45] May 17, 1983

[54] TYPEWRITER

[75] Inventor: Jorge Costa, Yverdon, Switzerland

[73] Assignee: Hermes Precisa International S.A., Yverdon, Switzerland

[21] Appl. No.: 260,805

[22] Filed: May 5, 1981

[30] Foreign Application Priority Data

May 20, 1980 [CH] Switzerland ..... 3917/80

[51] Int. Cl.[3] ..... B41J 19/78

[52] U.S. Cl. ..... 400/569; 400/568; 74/354

[58] Field of Search ..... 400/569, 567, 902, 903, 400/639.1, 636.1, 161.3, 144.2, 553, 568; 74/352, 353, 354

[56] References Cited

U.S. PATENT DOCUMENTS

| | | | |
|---|---|---|---|
| 3,280,957 | 10/1966 | Thiel | 400/569 |
| 3,618,738 | 11/1971 | Boyatt et al. | 400/569 X |
| 3,935,938 | 2/1976 | Hodne | 400/569 X |
| 3,983,985 | 10/1976 | Guerrini et al. | 400/144.2 |

*Primary Examiner*—Edgar S. Burr
*Assistant Examiner*—Charles Pearson
*Attorney, Agent, or Firm*—Emory L. Groff, Jr.

[57] ABSTRACT

In the typewriter driving of the platen (1) is effected by the motor shaft (3) which operates a character selection device. This motor shaft (3) and the platen (1) occupy predetermined angular positions at rest.

During a driving command of the platen, a part (26) brings a transmission pinion (22) into mesh with the last controlled pinion (9) of a gear train (5 to 9) coupled to the motor shaft (3) before this shaft is actuated by the motor (4). The transmission pinion (22) is secured to one end of the transmission shaft (16, 19, 20) and the other end of the shaft carries a toothed wheel (15) in mesh with a driving pinion (14) secured to the platen. The angular notching of the pinions and their number of teeth is provided in such a manner that the teeth of the pinion (22) engage exactly between the teeth of the controlled pinion (9).

10 Claims, 4 Drawing Figures

TYPEWRITER

In known typewriters, the driving of the platen is effected by a ratchet wheel for the small angular displacements corresponding to the interline spacing and by a motor rotating continuously, via gears, for the larger angular displacements corresponding to the introduction or ejection of paper.

In more recent typewriters of the type with which the present invention is concerned, the driving of the platen is ensured by a servo-motor; a step-by-step (stepping) motor or a servo-motor controlled by a logic control circuit of the machine. The motor can drive the platen only or can drive other movements such as the displacements of the carriage along the platen or even the positioning of the typing of the characters to be printed. British Patent Application No. 8018442 describes a typewriter comprising a single motor driving the assembley of movements of the carriage and of the platen.

The present invention concerns a typewriter including a carriage displaceable along the platen, a servo motor coupled to a motor shaft for driving a selecting device for a character to be typed from the characters carried by a printing head disposed on the carriage, said motor shaft being adapted to occupy at least one angular rest position corresponding to the rest position of the printing head, a first gear train driven by the motor shaft and a second gear train driving the platen, the second gear train co-operating with an angular notching or ratchet device for retaining it in several angular positions.

The coupling of the transmission pinion is effected while the motor and the platen are immobile. The servo-motor is then controlled by the logic circuit of the typewriter in a manner to effect a rotation of the platen corresponding to the function controlled i.e. interline spacing or introduction or ejection of the paper. It is known to couple the transmission pinion to the controlled pinion by means of a friction clutch having springs or notches. The clutches, whatever their type, have, however, the disadvantage of wearing fairly rapidly. Their effectiveness reduces and a sliding between the controlled pinion and the transmission pinion can be produced from time to time. Such a sliding induces an error in the size of the line spacing and modifies the relationship between the angular position of the platen and the angular steps of the servo-motor.

An error in the size of a line space, which is unacceptable in a page of typing, can be corrected easily by the user when the typewriter is used in the usual manner. On the contrary, when the machine automatically types a memorized text, or the material to be typed is dictated by a computer output, the errors in the size of the line spacing can no longer be corrected in the course of typing and it is necessary to restart printing of the text or, in a case where it is possible, the printing of the pages containing the errors.

The object of the invention is to provide a typewriter in which the driving mechanism of the platen is simple, effective, and minimizes the risk of causing errors in the size of the interline spaces.

To this end, a typewriter, forming the subject of the invention, comprises a carriage displaceable along a platen, a servo-motor coupled to a motor shaft for driving a device for selecting a character to be printed from the characters carried by a printing head disposed on the carriage, said motor shaft being adapted to occupy at least one angular rest position corresponding to the rest position of the printing head, a first gear train driven by the motor shaft and a second gear train for driving the platen, said platen co-operating with an angular ratchet device, retaining it in several angular positions, characterized in that the first pinion of the second gear train is secured to a transmission pinion carried by a control member adapted, during a platen driving order, to bring the transmission pinion into engagement with the last controlled pinion of the first gear train when the platen and the motor shaft are immobile, the cogging and the number of teeth of the pinions being provided in a manner such that the teeth of the transmission pinion always engage between the teeth of the controlled pinion.

The invention will be described further by way of example, with reference to the accompanying schematic drawings in which.

Figure 1:
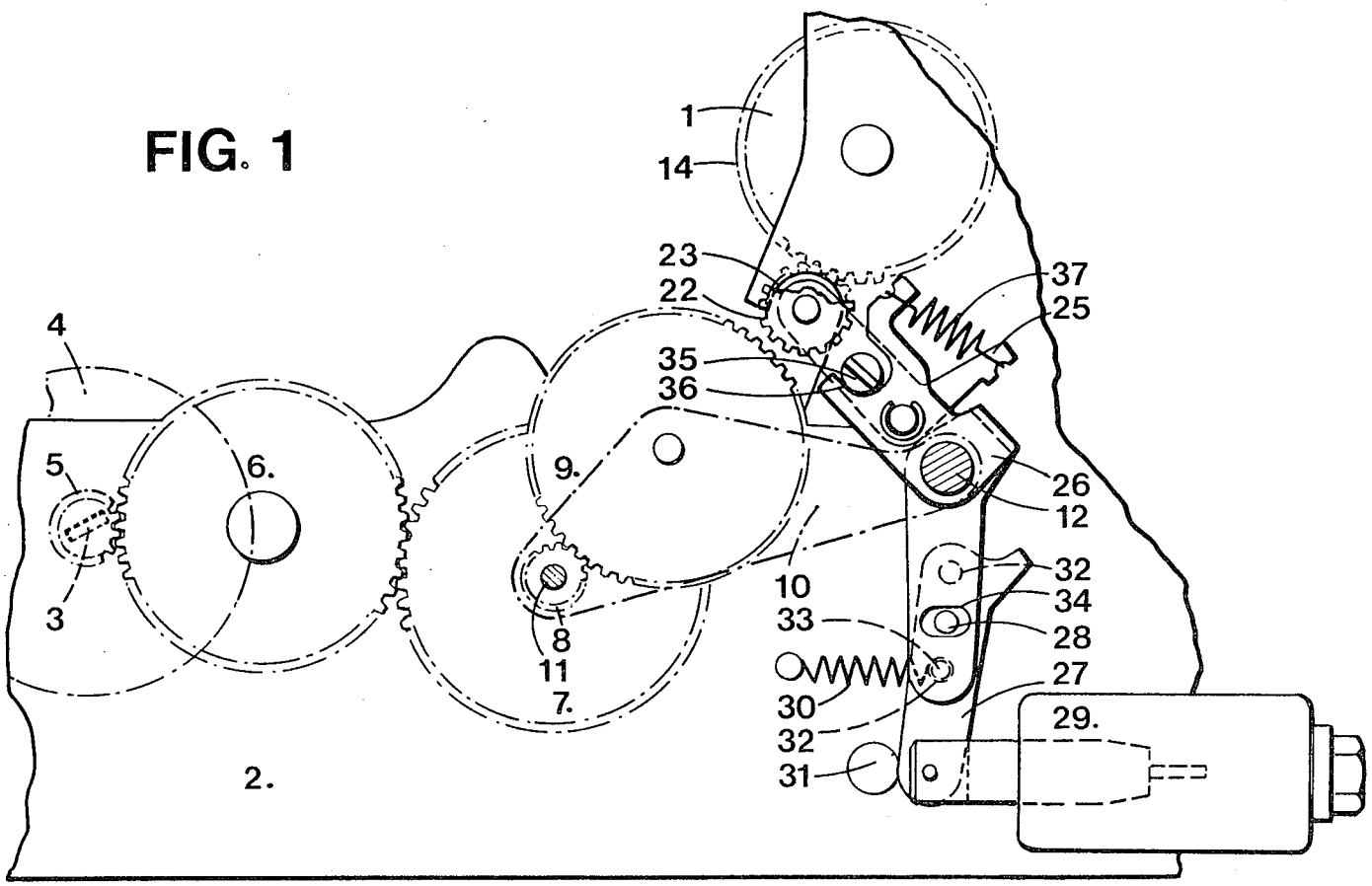
FIG. 1 is a partial elevational view of a driving mechanism for a platen of a typewriter.

The typewriter comprises a platen 1 mounted between two lateral walls 2 of the casing of the machine. A motor shaft 3 driven by a stepping motor 4 is mounted parallel to the platen 1 and extends through one of the walls 2 of the casing. The typewriter comprises a carriage slidable along the platen 1 and carrying a printing member constituted by a printing disc. This disc carries the assembly of characters and the selection of a character to be printed is effected by the motor shaft 3. In a known manner, when at rest, the printing member occupies a position in which the reading of the last characters typed is facilitated by a particular disposition of the printing characters on the periphery of the disc. This rest position of the printing member corresponds to an angular rest position of the motor shaft 3, this latter pivoting by one turn for a rotation of one turn of the disc.

One end of the motor shaft 3 carries a pinion 5 in mesh with a gear train 6, 7, 8 and 9. A controller pinion 9, constituted by the last pinion of the gear train, is rotatably driven each time the motor shaft 3 is actuated.

Figure 2:
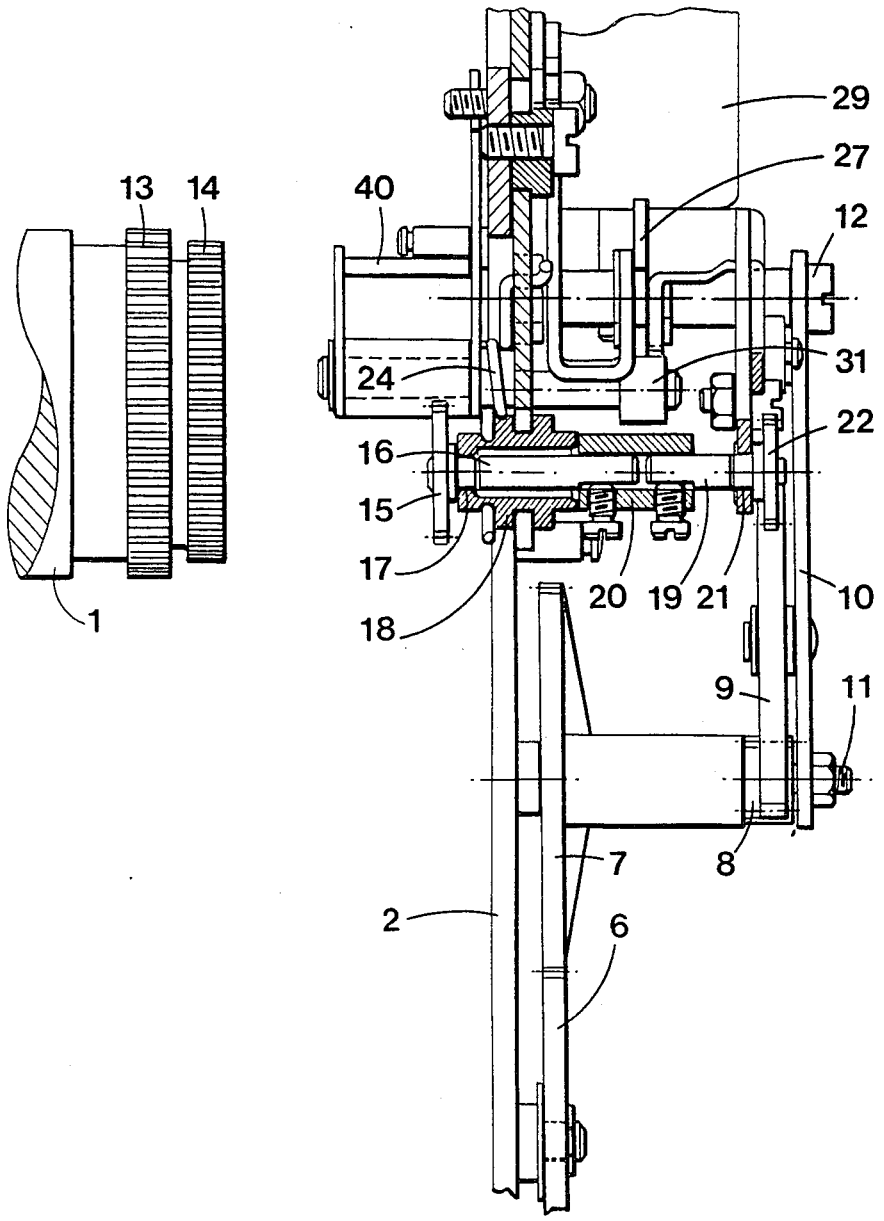
FIG. 2 is a side view in partial section of the drive mechanism.

As shown in FIG. 2, the wheels of the gear train are disposed in two planes. The wheels 5, 6 and 7 are disposed against the wall 2 of the casing, and the wheel 8 and the pinion 9 are pivotally mounted on a plate 10 secured to the wall 2 and maintained spaced away from the wall by pivots 11, 12 forming struts. The pivot 11 carries the wheels 7 and 8 which are angularly secured to each other.

The end of the platen 1 is shown in a position spaced away from its normal position adjacent the wall 2, in a manner to facilitate an understanding of the drawing. The end of the platen 1 comprises a locking wheel 13 and a driving pinion 14 angularly secured to the wheel 13. The driving pinion 14 is in mesh with a toothed wheel 15 secured to one end of a half-shaft 16 extending through a bearing 17 of a sliding part 18. The half-shaft 16 is secured to a second half-shaft 19 by means of a screw socket 20. The free end of the second half-shaft 19 extends through a bore 21 of a control part and carries a transmission pinion 22 adapted to co-operate with the controlled pinion 9.

The sliding part 18 is mounted in an elongate opening 23 of the wall 2 (FIGS. 1 and 3), this opening 23 being oriented radially with respect to the axis of rotation of the platen 1. The sliding part 18 is biassed by a torsion spring 24 in the direction of the axis of rotation of the platen 1 so that the toothed wheel 15 is always engaged against the driving pinion 14. The control member of the pinion 22 is constituted by a lever 26, one arm of which carries a pivotally mounted bell crank lever 25. The lever 26, pivoted around the pivot 12, is operated by an actuating lever 27 pivotally mounted around a pivot 28 secured to the wall 2 of the machine. An electro-magnet 29 is adapted to pivot the lever 27 about the pivot 28 against the action of a return spring 30 biassing the actuating lever 27 against an abutment 31.

The actuating lever 27 has two holes 32 disposed on both sides of its pivotal axis. The hole 32 disposed between the pivot 28 and the end of the lever influenced by the electro-magnet 29 receives a coupling finger 33 secured to an arm of the control lever 26, which has an opening 34 allowing the passage of the pivot 28.

The bell crank lever 25 carries an eccentric 35 coming into abutment against an extension 36 of the control lever 26 under the action of a spring 37. The adjustment of the play between the driving pinion 22 and the controlled pinion 9 is effected by means of this eccentric 35. At the moment of a command for the driving of the platen, the motor shaft 3 is in the rest position and the platen is locked in one of its notched angular positions.

The electro-magnet 29 is energized and, via the actuating lever 27, pivots the control lever 26 in a counterclockwise direction in FIG. 1, which brings the teeth of the transmission pinion 22 against those of the pinion 9. At the same time, the lever 27 actuates means for deactivating the angular locking of the platen 1.

The number of teeth of the pinions 9 and 22 is provided in such a manner that the teeth of the pinion 22 engage exactly between the teeth of the controlled pinion 9, each time the electro-magnet 29 is energized.

The number of teeth of the pinion 22 is directly related to the ratio of the transmission between the transmission pinion 22 and the platen 1 and to the number of angular positions, defined by the ratchet device 13,40 which the platen 1 can occupy in one revolution.

In a similar manner, the number of teeth of the controlled or drive pinion 9 is proportional to the ratio of the transmission between the motor shaft 3 and the pinion 9 and to the number of rest positions that the motor shaft 3 can occupy in one revolution.

When the pinion 22 is in mesh with the pinion 9, the motor 4 is turned on for turning the platen by an angle corresponding to the function commanded such as: interlining, introduction or ejection of the paper. The transmission shaft connecting the transmission pinion 22 to the toothed wheel 15 and which is formed by the two half-shafts 16 and 19 connected by the socket 20, is not displaced parallel to itself but subject to bias when the lever 26 is actuated, the bearing 17 of the sliding part 18 being a fixed point. Preferably, the axis of the transmission shaft 16, 19, 20 is oriented parallel to the axis of the platen 1 and to the axis of the pinion 9 when the transmission pinion is in mesh with the controlled pinion 9.

This construction is very simple, reliable and cheap. The transmission pinion 22 does not undergo any rotational movement when it meshes with the pinion 9, it only undergoes a translation in a direction perpendicular to the axis of the transmission shafts 16,19,20 towards the pinion 9 substantially in the direction of the rotational axis of the pinion 9.

As described above, the transmission pinion 22 is carried by the pivoting bell crank lever 25. This arrangement constitutes a safety factor permitting the avoidance of the destruction of the gears or of the motor 4 if the platen becomes accidently blocked; the driving pinion 22, influenced by the pinion 9, would lift itself against the action of the spring 37 and would disengage from the teeth of the pinion 9.

Figure 3:
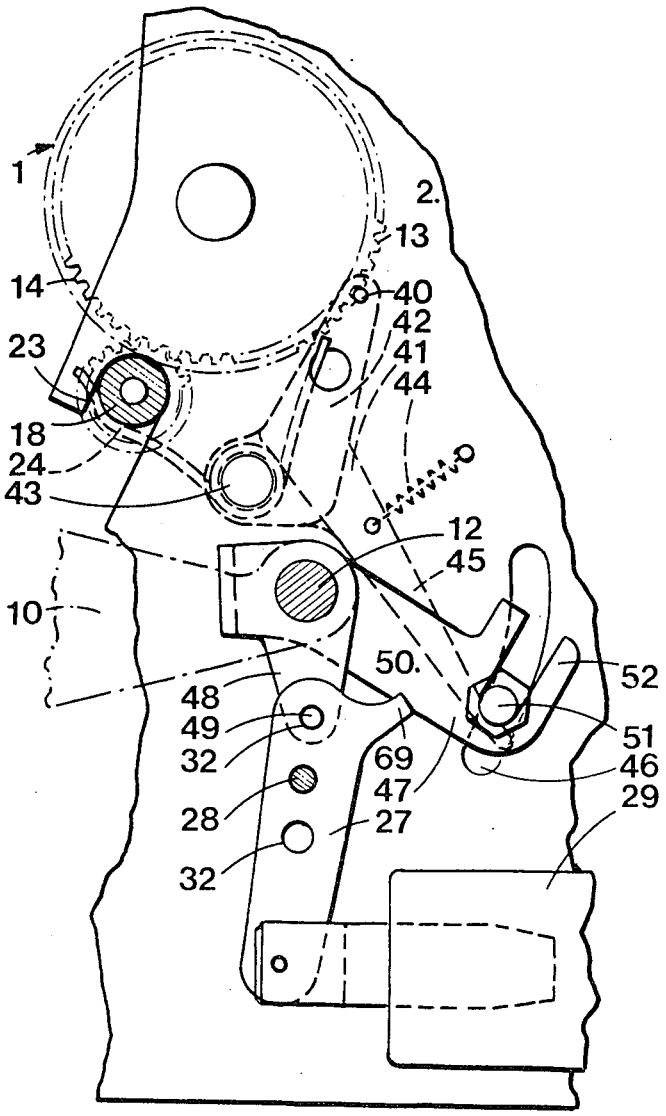
FIG. 3 is an elevational view of a lifting device for the notching means of the platen forming a part of the mechanism.

FIG. 3 illustrates the notching locking device of the platen 1 as well as the means for rendering it inactive.

A locking finger 40 is mounted between two parallel arms of two levers 41, 42 mounted on a pivot 43, and is resiliently biassed by a spring 44 in the teeth of the locking wheel 13. One of the levers 41 has an arm 45 extending opposite an opening 46 of the wall 2. A lever 47, pivotally mounted on a pivot 12, presents a first arm 48 the end of which is provided with a lug 49 engaged in a hole 32 of the actuating lever 27, and a second arm 50 carrying a finger 51 crossing through the opening 46 of the wall 2 and co-operating with the arm 45. The finger 51 is mounted in an elongate cut-out 52 permitting an adjustment of its position with respect to the arm 45 when the mechanism is at rest.

Each time that the electro-magnet 29 is energised for ensuring the coupling of the platen 1 to the motor 4, the lever 47 pivots in a clockwise direction in FIG. 3 and, via the finger 51 and the arm 45, removes the locking finger 40 from the teeth of the locking wheel 13.

Figure 4:
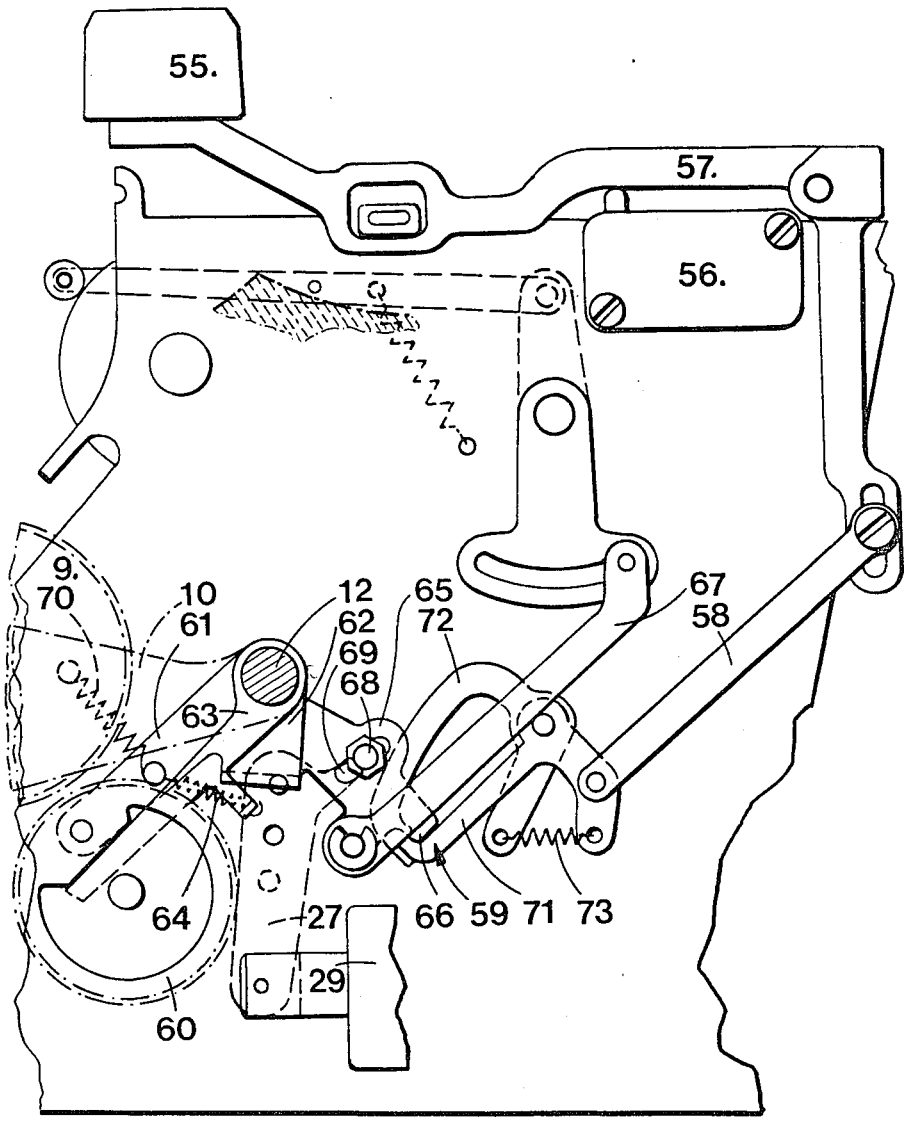
FIG. 4 is an elevational view of a raising control device of the paper presser bar forming a part of the mechanism.

FIG. 4 represents a device for raising the paper presser bar which is integrated with the driving mechanism of the platen. This device is actuated each time that one controls the function "paper introduction" by means of a key 55.

The key 55 is mounted on a lever 57 connected by a bar 58 to a retaining member 59 of a driving device for the bar.

The driving device for the bar comprises an eccentric cam 60 having a toothed periphery which is adapted to co-operate with the controller pinion 9. This cam 60 is pivotally mounted at the end of an arm 61 of a lever 62 mounted on the pivot 12 and is maintained in an angular rest position by an arm 63 the end of which is biassed by a spring 64 against a planar support surface of the cam 60. The spring 64 is secured to the two arms 63 and 61 and tends to draw them together.

A second arm 65 of the lever 62 presents a bend 66 co-operating with the retaining member 59 and is connected to a rod 67 adapted to drive the raising of the bar via levers and of the arm represented in broken lines in the drawing.

The second arm 65 carries a locking finger 68 adapted to co-operate with an extension 69 of the control lever 27.

During a paper introduction command, the bar 58 lifts the retaining member 59 and operates on a switch 56 for energizing the electro-magnet 29. The actuating lever 27 rocks in a manner to ensure the coupling of the platen 1 to the motor 4 and the disengagement of the locking finger 40 of the locking wheel 13. The extension 69 of the operating lever 27 moves away from the locking finger 68. The lever 62, biased by a spring 70, pivots and brings the cam 60 against the teeth of the controlled pinion 9. The motor 4 is then fed and effects the rotation of the platen 1 and, via the cam 60, raises the bar.

When the cam 60 has effected a complete revolution, it is locked in the rest position, as shown in FIG. 4 by the arm 63.

The locking member 59 is constituted by two levers 71 and 72 the ends of which, adapted to co-operate with the bend 66 are urged towards each other by a spring 73. This arrangement, known per se, avoids the release of two successive "raises" of the bar if the user has not released the key 55 when the cam 60 has effected a complete revolution.

It is to be noted that the movement of the paper presser bar is entirely controlled by the cam 60 and, in particular, the return of the paper presser bar against the platen is effected progressively contrary to known mechanisms in which the bar is returned by a spring. This avoids the marking of the copies by the bar when several copies are printed simultaneously.

When a sheet of paper is introduced over a short distance, the rotation of the platen is stopped whilst the bar is still raised. In this case the platen is locked in position and the motor is continuously fed until the bar has taken up its rest position resiliently bearing against the platen.

A typewriter equipped with the mechanisms described above only require a single motor to ensure the selection of a character to be typed and the rotation of the platen. It presents great reliability and great precision of the control of the platen movements and of the size of the interline spaces.

In this machine, the motor shaft presents a single rest position per revolution. One can, of course, provide a machine of the same type in which the motor shaft can be in the rest position in several angular positions. The number of teeth in the controlled pinion 9 is, of course, proportional to the number of rest positions of the motor shaft.

I claim:

1. A typewriter comprising a carriage displaceable along a platen (1), a servo-motor (4) coupled to a motor shaft (3) for driving a device for selecting a character to be printed from the characters carried by a printing head disposed on the carriage, said motor shaft (3) being rotatable so as to occupy at least one angular rest position corresponding to the rest position of the printing head, a first gear train (5 to 9) including first and last controlled pinions driven by the motor shaft and a second gear train including first and second pinions (14,15) for driving the platen (1), said platen (1) co-operating with an angular ratchet device (13,40) retaining it in several angular positions, characterized in that the second pinion (15) of the second gear train (14,15) is secured to a transmission pinion (22) carried by a control member (25,26) adapted, during a platen driving order, to bring the transmission pinion (22) into engagement with said last controlled pinion (9) of the first gear train (5 to 9) when the platen (1) and the motor shaft (3) are immobile, said last controlled pinion mounted on a pivotal axis, the number of teeth of the pinions of the first gear train (5 to 9), and of the second gear train (14,15) provided in such a manner that, when the motor shaft (3) rotates from any one of said rest positions to another of said rest positions or to the same rest position and when the platen (1) rotates from any one of said angular positions to another of said angular positions, said last controlled pinion (9) and said transmission pinion (22) rotate through an angular displacement equal to an integer number of teeth, the cogging of the pinions being such that the teeth of the transmission pinion (22) always fit between the teeth of the last controlled pinion (9) during a platen driving order.

2. A typewriter as claimed in claim 1, in which the number of teeth of the transmission pinion (22) is directly related to the number of positions, defined by the ratchet device (13, 40) that the platen (1) can occupy in one rotation and of the ratio of the transmission of the second gear train (14, 15).

3. A typewriter as claimed in claim 2, in which the number of teeth of the last controlled pinion (9) is directly related to the number of rest positions that the motor shaft (3) can occupy during one revolution and to the transmission ratio of the first gear train (5 to 9).

4. A typewriter as claimed in claim 3, in which the second pinion (15) of the second train (14, 15) is constituted a toothed wheel in mesh with a driving pinion (14) secured to the platen and is guided in a bearing (17) of a sliding part (18) resiliently biassed radially towards the axis of the platen (1).

5. A typewriter as claimed in claim 4, in which the transmission pinion (22) and the toothed wheel (15) are disposed at the two ends of a transmission shaft (16,19,20) extending through on the one hand, the bearing (17) of the sliding part (18) near the toothed wheel (15) and, on the other hand, a corresponding bore (21) of the control member (25,26) near the transmission pinion (22), the control member (25,26) being adapted to be displaced substantially transverse to the axis of the transmission shaft (16,19,20) and biasing said transmission shaft about a fixed point constituted by the bearing (17) of the sliding part (18).

6. A typewriter as claimed in claim 5, in which the axis of the transmission shaft (16, 19, 20) is oriented substantially parallel to the axis of the platen (1) and to the pivotal axis of the last controlled pinion (9) when the transmission pinion (22) is in mesh with said last controlled pinion (9).

7. A typewriter as claimed in claim 6, in which said control member (25, 26) comprises a lever (26) adapted to be operated by an electro-magnet (29) against the action of a return spring (30) in the rest position during a platen (1) driving command, an arm of this lever (26) carrying a bell crank lever (25) presenting the bore (21) for the transmission shaft (19) and which is resiliently biassed against an abutment (35) in the direction of the controlled pinion, the transmission pinion (22) being spaced apart from the last controlled pinion (9) in the rest position of the lever (26).

8. A typewriter as claimed in claim 7, in which the abutment is constituted by an eccentric (35) carried by the bell-crank lever (25) and bearing against an extension (36) of the arm of the lever (26), said eccentric (35) permitting the adjustment of the rest position of the transmission pinion (22) when the lever (26) is in the rest position.

9. A typewriter as claimed in claim 8, in which it comprises disengaging means (45 to 51) for said angular ratchet device (13,40), said means being operated by the electro-magnet (29) at each driving command of the platen (1) by the motor (4).

10. A typewriter as claimed in claim 8, comprising a raising device (60 to 70) of a paper presser bar adapted to be activated during a paper introduction command, associated with a platen (1) driving command from the motor (4), said device (60 to 70) comprising an eccentric toothed wheel (60) adapted to enter into engagement with the controlled pinion (9) and, via levers (62), to lift up the paper presser bar during driving of the platen.

* * * * *